US005902086A

United States Patent [19]

Enoki

[11] Patent Number: 5,902,086

[45] Date of Patent: May 11, 1999

[54] PROCESS FOR MANUFACTURING A DEFORMED METAL CAN HAVING A RESHAPED CAN BODY WALL

[75] Inventor: Yasushi Enoki, Sagamihara, Japan

[73] Assignee: Daiwa Can Company, Tokyo, Japan

[21] Appl. No.: 08/954,228

[22] Filed: Oct. 20, 1997

[30] Foreign Application Priority Data

Oct. 21, 1996 [JP] Japan ..... 8-297750

[51] Int. Cl.[6] ..... B21D 51/28

[52] U.S. Cl. ..... 413/76; 413/69; 413/73; 413/75

[58] Field of Search ..... 413/76, 69, 73, 413/75; 72/379.2, 379.4, 102, 105, 106, 5

[56] References Cited

U.S. PATENT DOCUMENTS

| | | | |
|---|---|---|---|
| 4,487,048 | 12/1984 | Frei | 72/105 |
| 5,035,569 | 7/1991 | Alznauer | 413/76 |
| 5,160,031 | 11/1992 | Palisin, Jr. et al. | 413/69 |
| 5,261,261 | 11/1993 | Ramsey | 72/379.4 |
| 5,759,651 | 6/1998 | Machii et al. | 413/5 |

FOREIGN PATENT DOCUMENTS

| | | | |
|---|---|---|---|
| 0477348 | 10/1974 | Australia | 413/69 |
| 49-28492 | 3/1974 | Japan . | |
| 54-29949 | 9/1979 | Japan . | |
| 55-27491 | 2/1980 | Japan . | |
| 0168737 | 10/1982 | Japan | 413/69 |
| 57-193240 | 11/1982 | Japan . | |
| 60-37231 | 2/1985 | Japan . | |
| 60-75559 | 4/1985 | Japan . | |
| 60-92028 | 5/1985 | Japan . | |
| 0199536 | 10/1985 | Japan | 413/69 |
| 60-45969 | 10/1985 | Japan . | |
| 61-50696 | 11/1986 | Japan . | |
| 2-104430 | 4/1990 | Japan . | |
| 2-30939 | 7/1990 | Japan . | |
| 5-503878 | 6/1993 | Japan . | |
| 5-504724 | 7/1993 | Japan . | |
| 2076514 | 12/1981 | United Kingdom | 413/69 |

*Primary Examiner*—James F. Coan
*Assistant Examiner*—Gene L. Kim
*Attorney, Agent, or Firm*—Oblon, Spivak, McClelland, Maier & Neustadt, P.C.

[57] ABSTRACT

A process for manufacturing a cylindrical metal can having, on its side walls, projected portions and recessed portions. The projected portions are formed by forcing the side walls radially outwardly, and the recessed portions are formed by urging unprojected portions radially inwardly while the projected portions are being forced radially outwardly.

5 Claims, 6 Drawing Sheets

PROCESS FOR MANUFACTURING A DEFORMED METAL CAN HAVING A RESHAPED CAN BODY WALL

BACKGROUND OF THE INVENTION

1. Field of the Invention

The present invention relates to a technique for manufacturing metal cans having can body walls with contoured configurations.

2. Related Art

Beverage cans are generally manufactured into two different forms i.e., a three-piece can and a two-piece can. Of these, the three-piece can is manufactured from sheet metal, such as a steel sheet treated electrically with chromic acid or subjected to other surface treatments, by rolling a rectangular piece of such sheet metal (or a blank), soldering, welding or bonding both sides of the blank to form a cylindrical can body, necking an upper portions in the vicinity of both open ends of the cylindrical can body into a reduced diameter, flanging edges at both open ends radially outwardly, double seaming a can end to one of the open ends and attaching another can end to the other open end by double seaming after filled with a beverage product. On the other hand, the two-piece can is typically manufactured from a tinplate sheet or an aluminum alloy sheet by blanking and deep drawing or blanking, drawing and ironing such sheet to form a cylindrical can body with an integral can bottom and open top end, necking an upper portion in the vicinity of the open top end into a reduced diameter, flanging an edge at the open top radially outwardly and attaching a can end to the open end of the can body by double seaming after filled with a beverage product.

In the industry, all these beverage cans are produced massively and relatively economically to substantially an identical shape. As the cans are produced substantially to an identical shape, they can not adequately be discriminated or differentiated from one another by their appearance. As the beverage cans are manufactured massively and relatively economically as above and no comparable beverage packaging in another form is readily available, there are strong desires among beverage manufacturers for economical beverage cans with unique configurations to help differentiate their products.

In their efforts for satisfying such desires of the beverage manufacturers, many can manufacturers have been trying to add improvements to their manufacturing technology and a number of processes for reshaping the can bodies have been proposed to date.

One example of such reshaping processes have been disclosed in Japanese Patent Laid-Open Application No. 28492/1974. This Japanese Patent Laid-Open Application discloses a reshaping process wherein a can body is expanded radially outwardly from its interior and provided with a contour of rigid patterns by a rubber cylinder having a plurality of recesses being disposed circumferentially and a plurality of split segments. As a three piece can body is not subjected to an intensive metal work such as the drawing and ironing operations, it retains sufficient ductility to permit adequate expansion to form a desired contour by the aforementioned reshaping process.

Although a three-piece can manufactured by a conventional method retains sufficient ductility to permit such adequate expansion, a drawn and ironed can having undergone intensive metal works, i.e., drawing and ironing operations, no longer retains adequate ductility so that a conspicuous contour to give desired effects are not attainable thereon.

More specifically, the drawn and ironed can has been ironed substantially to the limit of its formability capability so as to form a very thin can body wall, so that the can body essentially has extremely reduced ductility due to work hardening and residual stress. With the aforementioned reshaping process, therefore, a drawn and ironed can body may be ruptured before a desired contour is formed thereon. While the greater the expansion (or difference in diameter between expanded portions of the can body and an initial can body diameter before expanding operations), the more conspicuous the contour becomes, an expansion of the can body beyond the limit of its elongation may result in tear or rupture of the can body. In order to prevent rupture of the can body, the can body may be reshaped to a lesser extent within the limit of the elongation or the reshaping can take place after the can body is annealed to release the residual stress and restore its ductility, but following disadvantages still remain to be overcome.

Firstly, the reshaping to a lesser extent makes a contour on the can body less conspicuous and adequate effects for product differentiation are not attainable. Secondly, annealing of a drawn and ironed can body will result in reduced physical strength and internal pressure resistance to such extent that the can body may be crashed during necking or double seaming operation, or a bottom dome of the can body may be buckled by the internal pressure created when the can has been filled with a beverage product and sealed. If walls of the can body are made thicker to compensate for the reduced physical strength, there arises another disadvantage that increased mass of metal makes the can body less economical.

Although a three-piece can manufactured by a conventional method retains sufficient ductility to permit adequate expansion by the aforementioned reshaping process, such process causes a disadvantage also with the three-piece can in that the metal in the portions of the three-piece can body surrounded by the expanded portions are pulled by the expanding operation and expanded radially outwardly to an extent that the edges of the expanded portions can not clearly be configured to attain desired conspicuousness.

With the reshaping process disclosed in Japanese Patent Laid-Open Application No. 28492/1974, a can body is expanded radially outwardly from its interior and provided with rigid relief patterns by a rubber cylinder having a plurality of recesses being disposed circumferentially and a plurality of split segments. This process has a disadvantage in that the portions of the three-piece can body surrounded by adjacent relief patterns are forced to expand radially outwardly and adequately conspicuous relief patterns can not be attained on the can body. The closer the adjacent relief patterns are disposed one another, the less conspicuous boundaries of the patterns and the less rigid the patterns become.

Another reshaping process devised particularly for draw and ironed cans has been disclosed in Japanese Patent Laid-Open Application No. 75559/1985. According to this process, a drawn and ironed can body manufactured from an aluminum alloy sheet is subjected to a heat treatment for improvement of its mechanical elongation and expansion capability. However, this process has a disadvantage in that it essentially results in substantial increase of costs of manufacturing the drawn and ironed cans due to a heat treatment process to be added.

For the reasons thus far discussed, reshaping processes have not been used commercially for drawn and ironed cans and have found only a limited use in three piece cans of specific designs, such as a barrel shaped can, which do not need to stress highly conspicuous hill and valley configurations.

SUMMARY OF INVENTION

An object of the present invention is to provide means for applying unique and conspicuous relief patterns to a can body and to form highly conspicuous relief patterns, without annealing or any other heat treatment, to a can body with reduced ductility such as a deep drawn 2-piece can made of a surface treated steel sheet or aluminum alloy sheet or a drawn and ironed can made of an aluminum alloy sheet.

According to the present invention, a can body firstly undergoes an expanding operation and is subjected, at a plurality of predetermined portions of its interior surfaces, to radially outward pressure and is expanded to form radially outward projections at such predetermined portions of the can body. In this instance, the portions of the interior surfaces of the can body other than the aforementioned predetermined portions are urged radially outwardly, but residual stress in such other portions causes repelling force for restoring their original configurations, so that such other portions are formed into generally flat portions or shallow U-shaped recesses of inconspicuous boundaries. As the boundaries of the flat portions or U-shaped recesses and the expanded portions do not appear clearly, the can body has generally obscure curvature configuration at this point in time.

Subsequently, the can body undergoes an expanding operation and, while being forced radially outwardly and supported at the interior surfaces of the expanded portions, it is subjected, at least partially at the exterior surfaces of the aforementioned other portions which have not undergone the radially outward pressure, to radially inward pressure and deformed inwardly.

It is to be noted that, according to the present invention, a can body undergoes the expanding operation only at the predetermined portions of its interior surfaces, and the portions of the can body other than the aforementioned predetermined portions, which have not been subjected to the radially outward force and have residual stress causing repelling force for restoring their original configurations, are subjected, at the exterior surfaces, to radially inward deformation. In this manner, the can body remains free from an excessive metal work in the radially inwardly deforming operation. As the can body is deformed radially inwardly while being pressed and supported at the interior surfaces of the expanded portions, the boundaries of the deformed portions and the expanded portions are clearly formed and the can body with a highly conspicuous contour is obtained.

In the process according to the present invention, a can body, which has been necked-in, is received on a radially expandable member which is freely rotatable. As the radially expandable member is expanded, its peripheral surfaces are urged against and thereby force and deform a plurality of predetermined portions of the interior surfaces of the can body radially outwardly to form radially outward projections. In this instance, the can body has portions in its interior surfaces that have not been forced radially outwardly by the radially expandable member. However, such portions are influenced by the adjacent projections and urged radially outwardly to some extend, so that such portions are formed into shallow recesses in relation to the projections and the projections do not become highly conspicuous. At this point in time, therefore, the can body has a generally obscure curvature configuration.

Subsequently, with the can body being supported at its interior surfaces by the expandable member which remains being expanded, the portions of the can body which have not been forced radially outwardly, or the shallow recessed portions, are forced radially inwardly at their exterior surfaces by an embossing member and thereby formed into valleys between adjacent projections. In other words, the shallow recesses in the portions of the can body which are not in contact with the radially expandable member received in the can body are forced radially inwardly at their exterior surfaces by the embossing member so that in effects the respective recessed portions and projections of the can body are urged in the radially opposite directions with each other by the embossing member and the radially expandable member respectively. As a result, the boundaries between the recessed portions and the projections are clearly defined and a conspicuous contour of relief patterns is formed on the can body. In this manner, a can body is provided with unique and highly conspicuous relief patters on its surfaces.

Further, in the present invention, the radially expandable member in its full expansion for forming the projections may be slightly contracted to reduce its radially outward force against the can body before the recessed portions are formed into the valleys, so that tensile stress at the portions of the can body which are not subjected to the radially outward force is reduced and flow of metal from the projected portions is facilitated. In this manner, can bodies that have reduced ductility and limited formability capability such as a drawn and ironed can body made of an aluminum alloy sheet and a deep drawn can made of a surface treated steel sheet or an aluminum alloy sheet can be provided with a desired highly conspicuous and unique contour of relief patterns without being torn or ruptured during the embossing operation to form the valleys, or without an added heat treatment process.

The above and further objects and novel feature of the present invention will more fully appear from the following detailed description when the same is read in connection with the accompanying drawings. It is to be expressly understood, however, that the drawings are for the purpose of illustration only and are not intended to define the limits of the present invention.

DETAILED DESCRIPTION OF THE PREFERRED EMBODIMENT

The present invention will hereunder be described in detail. Firstly, a can body to be used in the present invention may be either a three-piece can or a two-piece can which, without limitations, can be made of any of various surface treated steel sheets such as a conversion coated tinplate sheet having a layer of Sn, Ni or Sn/Ni, a steel sheet electrically treated with chromic acid, a film laminated steel sheet having a synthetic resin film on a surface treated steel sheet, or a conversion coated aluminum alloy sheet.

Such can body is preferably decorated by printing or laminating a pre-printed thermoplastic synthetic resin film in advance as it can not readily be decorated afterwards. Generally, it is preferable to have the can body covered with a synthetic resin film or a film of coating beforehand as direct contact of exposed metal surfaces of the can body with any tool, such as a die or the like, should be avoided.

When a two-piece can body is radially outwardly expanded, metal at an open end of the can body is pulled into expanded portions, and due to different elongation ratios depending on rolling direction of a metal sheet formed into the can body, flow of the metal essentially varies at different portions of the circumference of the open end, which may result in variations of height of the can body. In order to eliminate such can height variations, therefore, it is preferable to work harden the circumference of the open end of the can body beforehand at least by having the can body undergo the necking operation after its interior is covered with a film of synthetic resin or coating while the flanging operation may take place either before or after the expanding operation.

Figure 1:
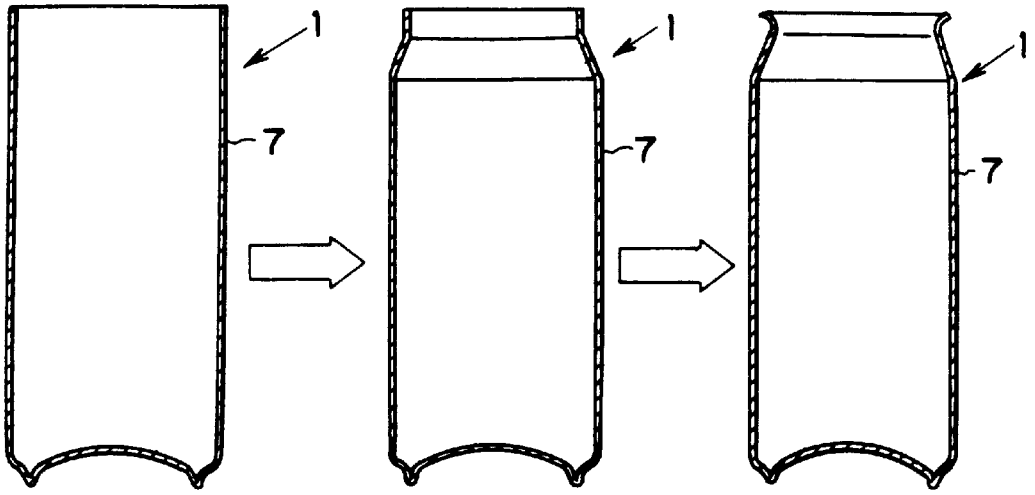
FIG. 1 is a process diagram showing steps of necking and flanging a drawn and ironed can body as applied in an embodiment of the present invention.

An embodiment of the present invention will now be described with reference to the accompanied drawings. In this embodiment, a drawn and ironed cylindrical can body having an initial diameter of 62.5 mm, a height of 134 mm and a wail thickness of 0.155 mm was manufactured from a sheet of aluminum alloy 3004-H191 having a thickness of 0.3 mm. The cylindrical can body was then coated and decorated with inks at its exterior surfaces and exposed to a temperature of 250° C. for 6 seconds to thermally cure the coating and inks. Subsequently, the cylindrical body received sprays of an epoxy phenolic coating at its interior and was exposed to a temperature of 230° C. for 60 seconds to thermally cured the interior coating. After these processes, the cylindrical body was necked and flanged to provide a can body 1, as shown in FIG. 1.

Figure 2:
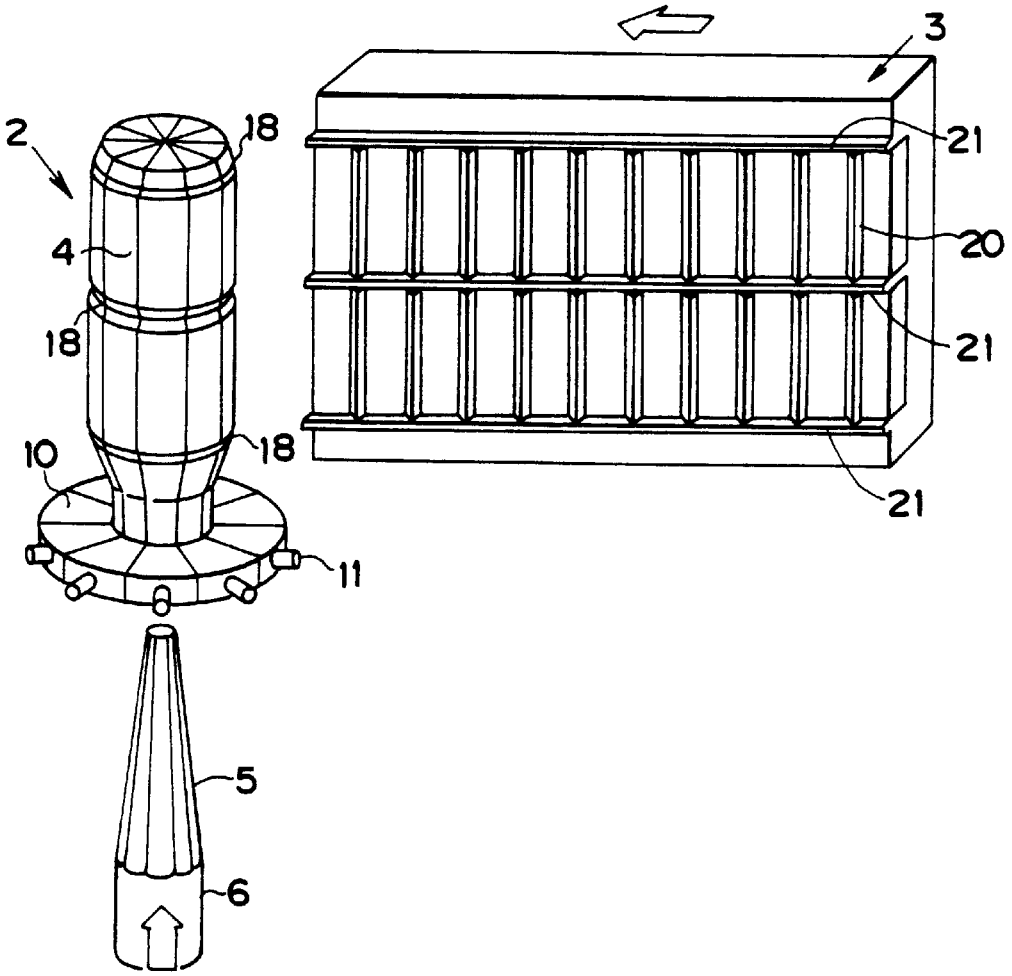
FIG. 2 is a schematic diagram showing a radially expandable member and an embossing member in the embodiment of the present invention.

FIG. 2 shows major portions of a radially expandable member and an embossing member, as used for forming a contour of relief patterns on side wall portions of a two-piece can according to the embodiment of the present invention. In this embodiment, an expandable mandrel 2 is used as the radially expandable member and an external die 3 is used as the embossing member. The expandable mandrel and the external die are provided respectively with projections and recesses of specific profiles which are arranged in such manner that both members can be engaged with each other.

The expandable mandrel comprises 10 pieces of split segments 4 having, as an assembly, a cylindrical diameter a little smaller than the diameter of the can body 1, a cylindrical profile substantially similar to the profile of the can body and a central tapered bore being disposed axially with its diameter being gradually reduced towards an upper end of the assembly where an integral bottom end of the can body opposite to the open end thereof is received, so that the mandrel is expanded as a tapered plunger is inserted into the bore.

Figure 3:
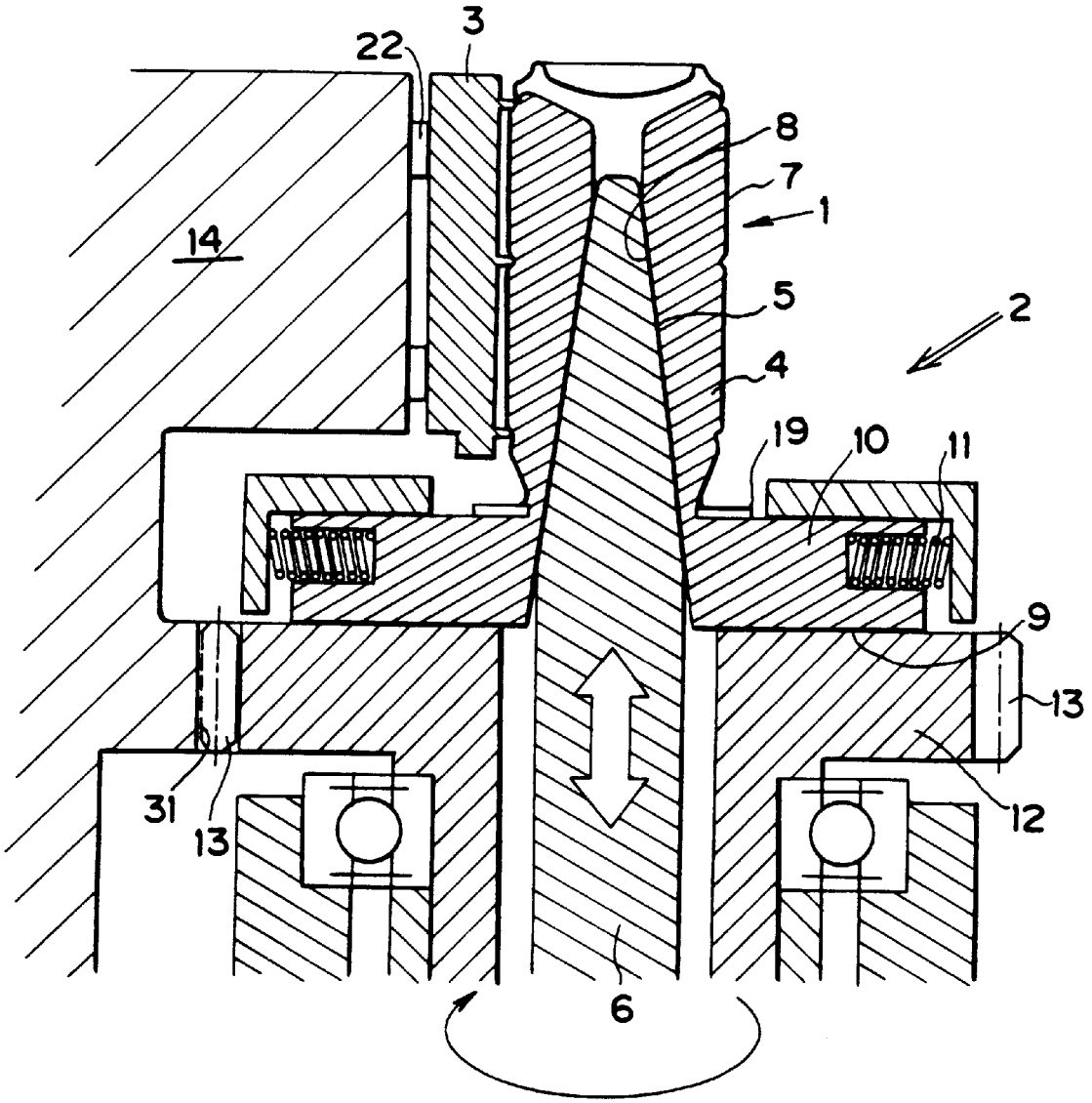
FIG. 3 is a section view showing the state in which the radially expandable member, received in the can body, is in its expanded position by the function of a plunger therein and the can body is being urged radially inwardly at its exterior surfaces by the embossing member.

FIG. 3 shows the state in which the mandrel 2 in an expanded position, with the plunger 6 being inserted in the tapered bore of the assembled split segments 4, holding the can body 1 against the external die 3. As shown, each split segment 4 is of L-shape and has a guiding surface 8 which is provided such that the split segment moves horizontally outwardly as it is urged by plunger 6. The split segment has a base 10 which remains free from contact with the can body 1 and the base has a sliding surface 9 and carries, at its tip, a resilient member which is shown as a coil spring 11 as an example.

Under the base 10, there is disposed a bed 12 for slidably supporting the split segment 4 and the plunger 6 extends through a central portion of the bed. The bed 12 is provided, at its externally projected peripheral portion with pinions 13 which are in engagement with a rack 31 disposed at a lower portion of an external die supporting member 14 to which the external die 3 is mounted. The bed 12 is freely rotatable and as it is driven by a suitable means, the split segments are rotated together with the plunger 6, so that the split segments 4 rotate proportionally relative to movement of the external die 3.

The split segments 4 defining an outer circumference of the expandable mandrel 2 as an assembly are provided with projections as shown in FIG. 2 and FIG. 3. In this embodiment, as an example, these projections are arranged in such manner that, for forming a plurality of longitudinal flutes 15 and a plurality of horizontal grooves 16 on the surfaces 7 of the can body, relatively recessed portions or grooves corresponding to such flutes and grooves on the surfaces of the can body are disposed on the outer circumference of the expandable mandrel. More specifically, the plurality of longitudinal flutes correspond with gaps 17 formed between each adjacent split segment of the expandable mandrel 2 in its expanded position and the plurality of horizontal grooves correspond with the grooves on the split segments in this embodiment. In other words, each split segment is provided with no grooves corresponding with the longitudinal flutes to be formed on the surfaces of the can body but has horizontal grooves 18 each being disposed respectively at its axially central portion, an upper end portion and a lower end portion corresponding respectively with an axially central portion, an upper end portion and a lower end portion of the can body 1.

A spacer 19 being mounted on an upper face of the base 10 and receiving a flanged end portion of the can body is used to adjust relative elevation of the can body 1 in relation to the external die 3 so that the can body with a different can height can be reshaped.

The external die 3 comprises, as an example in this embodiment, a flat panel member a die member mounted thereto. Arranged on surfaces of the external die 3 that come in contact with the can body 1 are a plurality of longitudinal ribs 20 which are disposed in spaced relation each corresponding with each gap 17 between adjacent split segments 4 of the expandable mandrel 2 in its expanded position. Arranged also on the surfaces of the external die 3 are three horizontal ribs 21 being disposed in portions corresponding to the aforementioned horizontal grooves 18 on the split segments 4 as shown in FIG. 2 and extending in a length greater than a circumferential diameter length of the can body having been expanded by the expandable mandrel. As the external die 3 is linearly moved by an air cylinder (not shown ), the expandable mandrel 2 is rotated by actions of the rack 31 and the pinions 13, so that the portions of the surfaces 7 of the can body 1 which are placed between the external die 3 and the expandable mandrel 2 are pressed radially inwardly by the longitudinal ribs 20 and the horizontal ribs 21.

For forming the horizontal grooves of the surfaces 7 of the can body, it is preferable to provide the horizontal ribs 21 with appropriate entry angles so as to gradually press the surfaces radially inwardly, as otherwise, undesirable pressure marks may develop on the surfaces at an initial contact by the ribs.

For adjustment of depth of the longitudinal flutes 15 and the horizontal grooves 16, it is also preferable to adopt an adjusting mechanism such as an adjusting screw 22, as shown in FIG. 3, between the external die 3 and the supporting member 14.

It should be appreciated that the radially expandable member such as the expandable mandrel 2 and the embossing member such as the external die 3 may adopt not only the longitudinal or horizontal ribs but also other forms of projections, and unless walls of the can body are clamped and pressed by the expandable member or the embossing member, the walls may not be damaged by such members. It should also be understood that the radially expandable member may be of other form than the radially expandable mandrel so long as it is expandable and carries projections and recesses of desired profiles and the embossing member may be of other form than the external die so long at it is so profiled as to mate with the projections and recesses of the radially expandable member.

For example, a piece of expandable rubber having a bore and being so profiled as to mate with the embossing member may be used as the radially expandable member, and an arcuate plate having working surfaces profiled to mate with the aforementioned projections and recesses of the radially expandable member, or a roll being constructed to rotate in proportional relationship with the radially expandable member and being profiled to mate with the aforementioned projections and recesses of the radially expandable member may be used as the embossing member. Also, the embossing member may be stationary and the can body may be urged against and rolled over the working surfaces of the embossing member.

Figure 4:
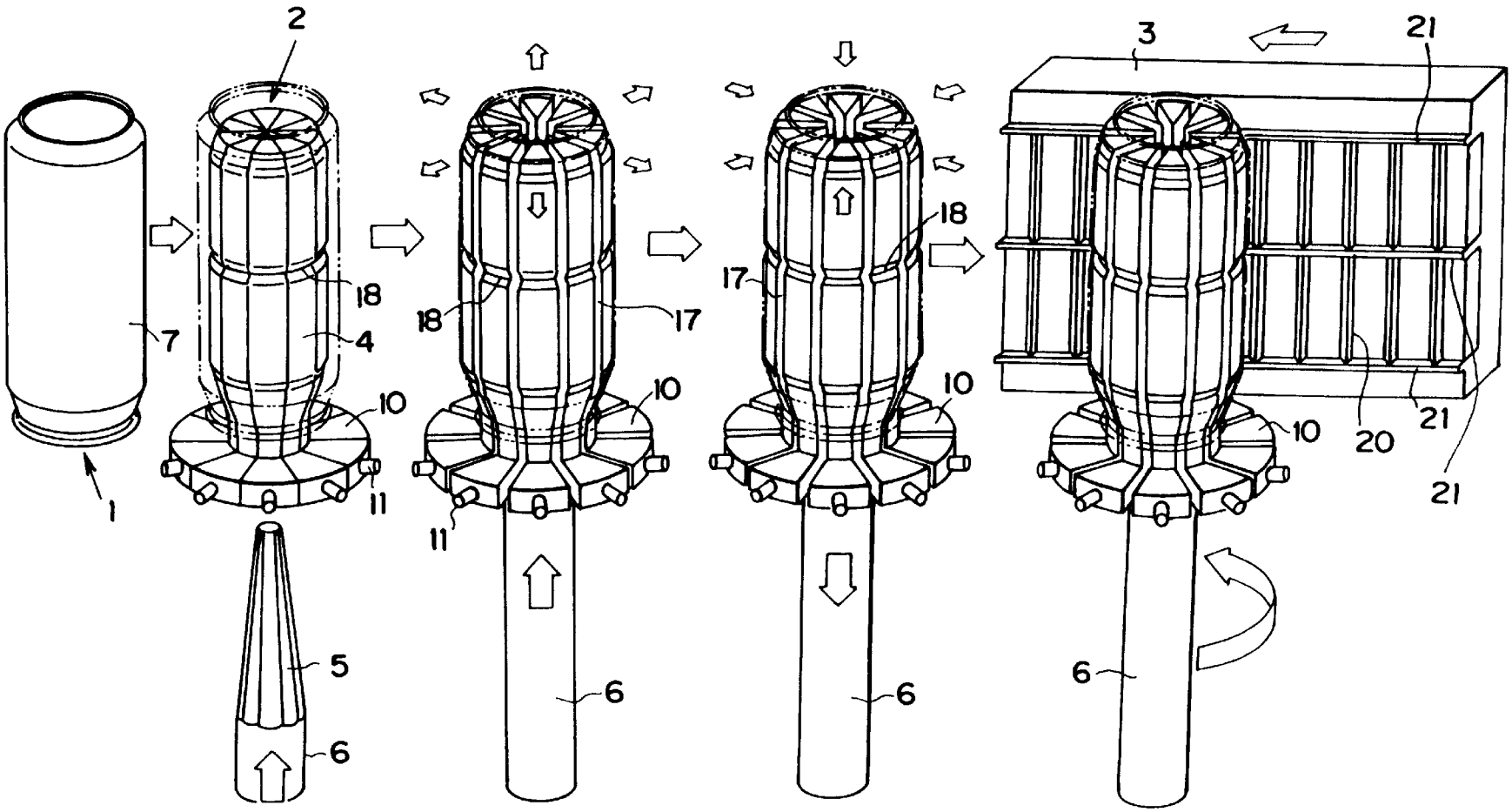
FIG. 4 is a schematic process diagram showing a step of forming projections and valleys on a necked and flanged can body.
Figure 5:
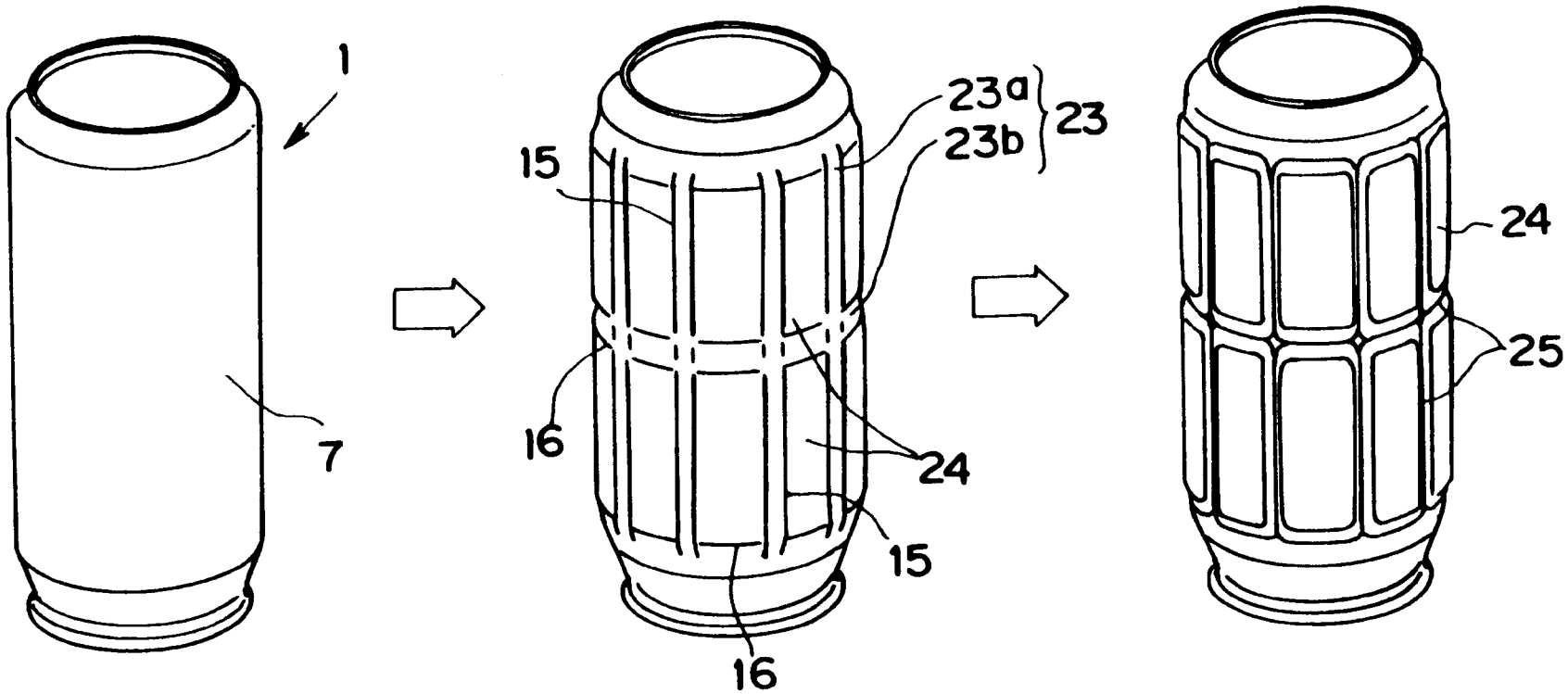
FIG. 5 is a schematic diagram sequentially showing the states, in which the necked and flanged drawn and ironed can body is radially outwardly expanded and deformed radially inwardly.

Procedure for providing the walls of the can body 1 with a desired pattern of projections and valleys using the expandable mandrel 2 as the radially expandable member and the external die 3 as the embossing member, both being constructed as thus far described, will now be discussed in reference to FIG. 3, 4 and 5.

First of all, the can body 1 is received on the expandable mandrel 2 in an unexpanded or original operating position. At this point in time, the flange of the can body is seated on the spacer 19 and thereby positioned correctly so that predetermined portions of the surfaces of the can body may be provided with a desired contour of projections and valleys.

As the tapered plunger 6 is moved upward by an appropriate driving means such as a hydraulic cylinder, for example, the tapered surface 5 of the tapered flange forces the expandable mandrel 2 to expand radially outwardly, so that gaps 17 will develop between respective adjacent split segments 17 and the outer periphery of the expandable mandrel 2 will come in contact with the interior surfaces of the walls of the can body. As the expandable mandrel further expands beyond an original diameter of the can body, the horizontal grooves 18 on the periphery of the split segments 4 and the gaps 17 between adjacent ones of the split segments form the relatively recessed horizontal and longitudinal portions 23 on the surfaces 7 of the can body. In other words, the external peripheral surfaces of the split segments of the expandable mandrel in an expanded position form the projected portions 24 on the surfaces 7 of the can body, whilst the gaps 17 between the respective split segments and the horizontal grooves 18 form the relatively recessed portions 23.

Describing more specifically as to how the relatively recessed portions 23 are formed, the portions of the surfaces 7 of the can body which are in contact with the split segments while the expandable mandrel is in an expanded position are physically forced and expanded radially outwardly, but the other portions of the surfaces 7 which correspond with the gaps 17 and the horizontal grooves 18 of the split segments remain free from direct contact with the split segments, so that such other portions are expanded only to a lesser extent and formed into a generally flat form of horizontal recesses 23*a* and generally u-shaped form of horizontal recesses 23*b*, both having obscure boundary lines 15 and 16, due to own repelling actions and tension of the walls of such other portions.

Subsequently, an amount of expansion of the expandable mandrel is adjusted in accordance with elongation capability of the walls of the can body and an amount of metal works to be involved in the following embossing operation to be followed so as to eliminate rupture of the can body during the embossing operation. This adjustment is done by means of the plunger inserted in the bore of the expandable mandrel after the can body is fully expanded, and with a drawn and ironed can body having limited elongation capability as used in this embodiment, the plunger 6 is retracted downwardly, allowing the split segments 4 to move radially inwardly after full expansion of the expandable mandrel.

This adjustment of expansion of the expandable mandrel may not necessarily be done for such can body as a three-piece can which has not undergone extensive metal works but is desired for a drawn and ironed can body which has undergone drawing and ironing operation and has only limited elongation capability. When elongation capability of the can body is expressed in terms of an expansion ratio (R), where R=an expanded can body diameter/an initial can body diameter, a maximum allowable expansion ratio is approximately R=1.15 for a three-piece can body made of a low tin steel sheet and approximately R=1.05 for a drawn and ironed can body made of an aluminum alloy sheet.

In other words, it is desirable that circumferential tension of the surfaces 7 of the can body due to expansion of the expandable mandrel 2 is relieved before the expanded can body is subjected to the embossing operation, and as the expanded can body shrinks to an extent by so called spring-back actions when the circumferential tension of the surfaces 7 is relieved, it is preferable to keep the amount of the aforementioned adjustment of expansion of the expandable mandrel to the amount of such shrinkage.

If this adjustment is made such that the split segments 4 move too far radially inwardly after the can body is expanded, the can body may turn or play on the expandable mandrel or the shallow recesses formed on the surfaces 7 of the can body may not meet with the external die correctly and therefore, the valleys to be formed on the surfaces 7 by the embossing operation may be off-registered. However, the amount of the adjustment of the expandable mandrel may made greater for such contour of projections and valleys that do not require accurate registration but need relief patterns to be formed by use of loose metal in the projected portions of the surfaces 7.

In this embodiment, the largest outside diameter of the fully expanded can body was 65.5 mm, the amount of expansion of the expandable mandrel was made by 0.5 mm in diameter and the ribs of the external die 3 urged the surfaces 7 of the can body by 1.2 mm radially inwardly.

Subsequently, the embossing operation takes place while the expandable mandrel 2 is in the adjustably expanded position, wherein the pinions 13 of the bed 12 comes in engagement with the rack 31 of the external die support member 14, so that the external die 3 is moved along a tangential line of the can body 1 while the expandable mandrel is rotated to spin the can body. As a result, the respective portions 23*a* and 23*b* of the surfaces 7 of the can body corresponding to the gaps 17 between adjacent split segments 4 and grooves 18 are urged radially inwardly by the respective ribs 20 and 21 of the external die 3, so that the aforementioned respective portions of the surfaces are formed into valleys.

Figure 6:
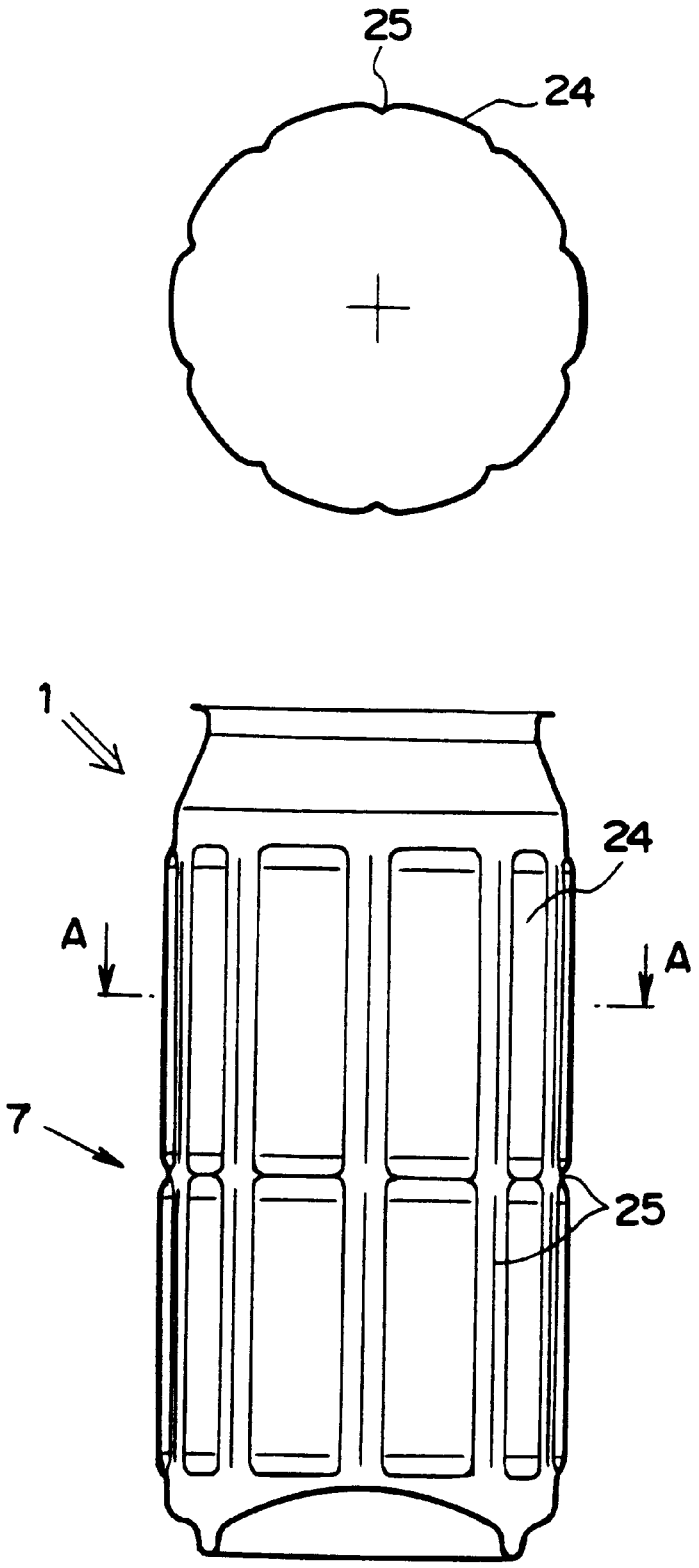
FIG. 6 is a schematic diagram representing a front elevation view of the necked and flanged drawn and ironed can body which has been provided with the projections and valleys in the embodiment of the present invention and a view at cross section A—A of the can body in the front elevation view.

As shown in FIG. 6, the can body reshaped as above has projections 24 and valleys 25 of adequately clear relief and the boundaries of the projections and valleys are clearly defined, so that a can body with a contour of highly conspicuous relief patterns is obtained. The can body thus reshaped had the initial outside diameter of 62.5 mm ,an imaginary outside diameter of the projections 24, as formed by their periphery, of 64.5 mm and the steps of 0.8 mm between the respective projections and adjacent valleys. As the amount of expansion of the expandable mandrel 2 is adjusted in accordance with elongation capability of the walls of the can body and an amount of metal works involved in the embossing operation, a deep drawn or drawn and ironed can body having limited elongation capability can by provided with a contour of highly conspicuous relief patterns without using additional treatments such as annealing. Also, an amount of expansion of the expandable mandrel may be reduced simply by adjustments of the plunger and no sophisticated mechanism is required in this respect.

In this embodiment, both upper and lower the projections 24 defined by the valley 25 in the axially central portion of the can body have been formed to a common peripheral imaginary diameter size, but the respective upper and lower projections may be formed to different diameter sizes by modifying the profiles of the split segments. With the process according to the present invention, the embossing operation takes place after the expanding operation to expand the surfaces 7 of the can body, and therefore, reshaping of a can body to various sophisticated contours is possible, such as a contour of a cask of wine having axially central wall portions projecting substantially outwardly or a contour having axially upper and lower wall portions projecting substantially beyond a peripheral diameter of a central wall portion, and the well known profile of Coca-Cola™ bottles, for example, can be reproduced on the surfaces of the can body.

In expanding a can body by means of conventional bulging processes, the whole interior of the surfaces of the can body is subjected to radially outward pressure, so that the embossing operations has to take place while the surfaces of the can body retain residual stresses, and therefore, the can body essentially has to undergo extremely tough metal works, resulting in rupture of the walls of the can body. With the process according to the present invention, unlike the aforementioned plugging processes, the whole interior of the surfaces of the can body is not subjected to radially outward pressure, but the can body is expanded to form the projections 24 by physically forcing only limited portions of the surfaces radially outwardly, and then the portions of the surfaces not being physically forced radially outwardly but have repelling actions to restore an original profile are urged radially inwardly in the embossing operation, so that the can body may undergo extremely tough metal works or result in rupture of the walls of the can body but can have a contour of highly conspicuous projections and valleys.

Figure 7:
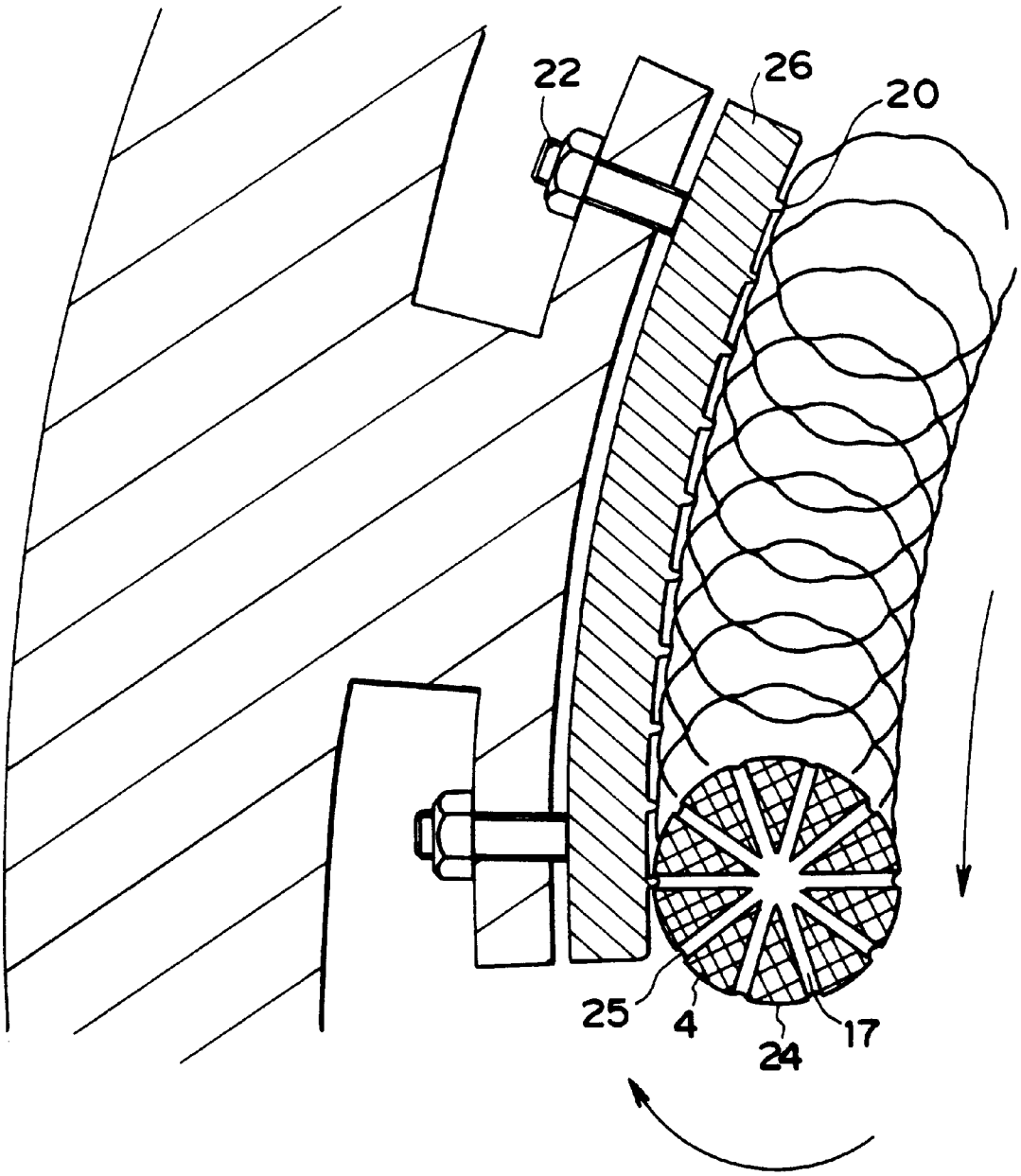
FIG. 7 is a schematic diagram showing a modified form of the embossing member in the embodiment of the present invention.

In this embodiment, the die member of the external die 3 is linearly moved along a tangent line of the can body while the can body is being span by the expandable mandrel 2, so that the portions of the surfaces 7 of the can body 1 which are placed between the external die 3 and the expandable mandrel 2 are pressed radially inwardly by the longitudinal ribs 20 and the horizontal ribs 21 of the external die. However, the external die may adopt another appropriate form such as a stationary arcuate plate 26, as shown in FIG. 7, having the longitudinal ribs 20 and horizontal ribs 21 on its working surfaces and the expandable mandrel may roll over the working surfaces of the external die. More specifically, the expandable mandrel 2 with one of the gaps 17 being set to a corresponding one of the longitude rib 20 may be rolled over the working surfaces of an arcuate external die 26 by means of the rack 31 pinions 13, so that the respective longitudinal ribs 20 will urge the corresponding portions of the surfaces of the can body one after another radially inwardly, and at the same time the horizontal ribs 21 gradually urges the corresponding portions of the surfaces of the can body radially inwardly. In this case, again, it is preferable to have an adjusting means to adjust an amount of initial urging pressure as referred to earlier, and for example, an adjusting screw 22 as shown in FIG. 7 may be used as such adjusting means.

The aforementioned embodiment uses longitudinal and horizontal valleys to be formed on the surfaces of the can body, but another contour of projections and valleys may be formed on the can body by profiling the radially expandable member and the embossing member to suit to such contour. Also, the radially expandable member is used for both expanding operation and embossing operation in this embodiment, but separate expandable member may be used respectively for the expanding operation and the embossing operation.

As discussed earlier, the radially expandable member may be of a piece of expandable rubber having a bore and peripheral surfaces so contoured as to carry projections and recesses of desired profiles. In this case, it is preferable that the recessed portions of the expandable member do not positively expand corresponding portions of the surfaces of the can body and that the embossing operation is effected to such corresponding portions of the surfaces of the can body.

As has been described so far, the present invention provides for a novel process with several advantages over conventional reshaping processes. With the process according to the present invention, only limited portions of the surfaces of the can body are physically forced to expand radially outwardly, and while such limited portions of the surfaces of the can body are being forced radially outwardly, at least portions of the surfaces not being physically forced radially outwardly but have repelling actions to restore an original profile are urged radially inwardly in the subsequent embossing operation, so that the can body may not undergo extremely tough metal works or result in rupture of the walls, but have a contour of highly conspicuous projections and valleys. Since the process according to the present invention can be added to any conventional beverage can manufacturing processes, a relatively inexpensive can body of a desired configuration can be manufactured commercially.

Since an amount of expansion of the expandable mandrel is adjusted to reduce the radially outward force urging the surfaces of the can body, relieving the tension of the portions to be subjected to the embossing operation to be followed and facilitating flow of metal from the expanded portions of the surfaces of the can body, rupture during the embossing operation of a can body having limited elongation capacity can be eliminated and a contour of unique and conspicuous relief patterns can be formed on the walls of various types of can bodies. For example, a can body with reduced ductility such as a deep drawn 2-piece can made of a surface treated steel sheet or aluminum alloy sheet or a drawn and ironed can made of an aluminum alloy sheet can be provided with a contour of unique and highly conspicuous relief patterns, without annealing or any other heat treatment.

What is claimed is:

1. A process for manufacturing a cylindrical metal can body having on its side walls a single or a plurality of radially outwardly projected portions and a single or a plurality of radially inwardly recessed portions, comprising:

a step of forming said projections on the side walls by inserting a radially expandable member into said can body and radially outwardly expanding said radially expandable member, a step of slightly shrinking said radially expandable member after the step of forming said projections, and a step of forming said recessed portions on the side walls of the can body, after the step of forming said projections, by applying an embossing member to portions of the side walls which are not forced radially outwardly in the step of forming said projections.

2. A process in accordance with claim 1, further comprising:

a step of forming a film of coating on one of external surfaces and interior surfaces of the cylindrical metal can body or bonding a film to said external or interior surfaces prior to said expanding operation.

3. A process in accordance with claim 1, further comprising:

a step of necking operation to form said cylindrical can body into a necked-in can body wherein portions of the side walls of said cylindrical metal can body in the vicinity of an open end thereof are reduced in diameter.

4. A process in accordance with claim 1, wherein the cylindrical metal can body is a drawn and ironed two-piece can body.

5. A process in accordance with claim 1, wherein the cylindrical metal can body is non-annealed.

* * * * *